US010714118B2

(12) United States Patent
Sadri

(10) Patent No.: US 10,714,118 B2
(45) Date of Patent: Jul. 14, 2020

(54) AUDIO COMPRESSION USING AN ARTIFICIAL NEURAL NETWORK

(71) Applicant: Facebook, Inc., Menlo Park, CA (US)

(72) Inventor: Pasha Sadri, Menlo Park, CA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 15/395,039

(22) Filed: Dec. 30, 2016

(65) Prior Publication Data

US 2018/0190313 A1 Jul. 5, 2018

(51) Int. Cl.

| | |
|---|---|
| ***G10L 25/30*** | (2013.01) |
| ***G10L 19/00*** | (2013.01) |
| ***G10L 19/02*** | (2013.01) |
| ***G10L 25/51*** | (2013.01) |

(52) U.S. Cl.

CPC ..... *G10L 25/30* (2013.01); *G10L 19/00* (2013.01); *G10L 19/02* (2013.01); *G10L 25/51* (2013.01)

(58) Field of Classification Search

CPC ..... G10L 19/00; G10L 19/02

See application file for complete search history.

(56) References Cited

U.S. PATENT DOCUMENTS

| | | | | |
|---|---|---|---|---|
| 5,692,098 | A * | 11/1997 | Kurdziel | G10L 19/02 704/202 |
| 5,737,716 | A * | 4/1998 | Bergstrom | G10L 19/02 704/202 |
| 5,774,856 | A * | 6/1998 | Haber | G10L 19/00 379/56.1 |
| 5,907,822 | A * | 5/1999 | Prieto, Jr. | G10L 19/005 704/202 |
| 7,295,608 | B2 * | 11/2007 | Reynolds | H04L 29/06 375/240 |
| 9,263,060 | B2 * | 2/2016 | Sharp | G10L 25/63 |
| 2006/0031066 | A1 * | 2/2006 | Hetherington | G10L 21/0208 704/226 |
| 2007/0219787 | A1 * | 9/2007 | Manjunath | G10L 19/22 704/207 |
| 2016/0217367 | A1 * | 7/2016 | Moreno | G10L 15/16 |

OTHER PUBLICATIONS

Morishima et al., "Speech Coding Based on a Multi-layer Neural Network", IEEE International Conference on Communications, Including Supercomm Technical Sessions, Atlanta, GA, 1990.*

* cited by examiner

*Primary Examiner* — Samuel G Neway

(74) *Attorney, Agent, or Firm* — Baker Botts L.L.P.

(57) ABSTRACT

In one embodiment, a method includes accessing a voice signal from a first user; compressing the voice signal using a compression portion of an artificial neural network trained to compress the first user's voice; and sending the compressed voice signal to a second client computing device.

19 Claims, 8 Drawing Sheets

AUDIO COMPRESSION USING AN ARTIFICIAL NEURAL NETWORK

TECHNICAL FIELD

This disclosure generally relates to audio compression.

BACKGROUND

A client computing device—such as a smartphone, tablet computer, or laptop computer—may include functionality for determining its location, direction, or orientation, such as a GPS receiver, compass, gyroscope, or accelerometer. Such a device may also include functionality for wireless communication, such as BLUETOOTH communication, near-field communication (NFC), or infrared (IR) communication or communication with a wireless local area networks (WLANs) or cellular-telephone network. Such a device may also include one or more cameras, scanners, touchscreens, microphones, or speakers. Client computing devices may also execute software applications, such as games, web browsers, or social-networking applications.

SUMMARY OF PARTICULAR EMBODIMENTS

In particular embodiments, an ANN may be trained to compress the voice of a user. The ANN may comprise an input layer, a middle layer, and an output layer. A compression portion of the ANN may comprise all layers of the ANN from the input layer to the middle layer, inclusive. A decompression portion of the ANN may comprise all layers of the ANN from the middle layer to the output layer, inclusive. A voice signal from the user may be compressed by inputting the voice signal to the compression portion of the ANN. The compressed voice signal may be the output of the middle layer. The compressed voice signal may be decompressed by the decompression portion of the ANN. The decompressed voice signal may be the output of the output layer. The middle layer of the ANN may comprise fewer nodes than any other layer of the ANN. In particular embodiments, the compressed voice signal may have a lower file size than the voice signal, which may result in faster transmission of the voice signal, using less bandwidth to transmit the voice signal, or using less storage space to store the voice signal. Although this disclosure describes compressing a voice signal in a particular manner or using a particular ANN, this disclosure contemplates compressing a voice signal in any suitable manner and using any suitable ANN.

The embodiments disclosed herein are only examples, and the scope of this disclosure is not limited to them. Particular embodiments may include all, some, or none of the components, elements, features, functions, operations, or steps of the embodiments disclosed above. Embodiments according to the invention are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

DESCRIPTION OF EXAMPLE EMBODIMENTS

In particular embodiments, an artificial neural network ("ANN") may be trained to compress the voice of a user. The ANN may comprise an input layer, a middle layer, and an output layer. A compression portion of the ANN may comprise all layers of the ANN from the input layer to the middle layer, inclusive. A decompression portion of the ANN may comprise all layers of the ANN from the middle layer to the output layer, inclusive. A voice signal from the user may be compressed by inputting the voice signal to the compression portion of the ANN. The compressed voice signal may be the output of the middle layer. The compressed voice signal may be decompressed by the decompression portion of the ANN. The decompressed voice signal may be the output of the output layer. The middle layer of the ANN may comprise fewer nodes than any other layer of the ANN. In particular embodiments, the compressed voice signal may have a lower file size than the voice signal, which may result in faster transmission of the voice signal, using less bandwidth to transmit the voice signal, or using less storage space to store the voice signal. Although this disclosure describes compressing a voice signal in a particular manner or using a particular ANN, this disclosure contemplates compressing a voice signal in any suitable manner and using any suitable ANN.

Figure 1:
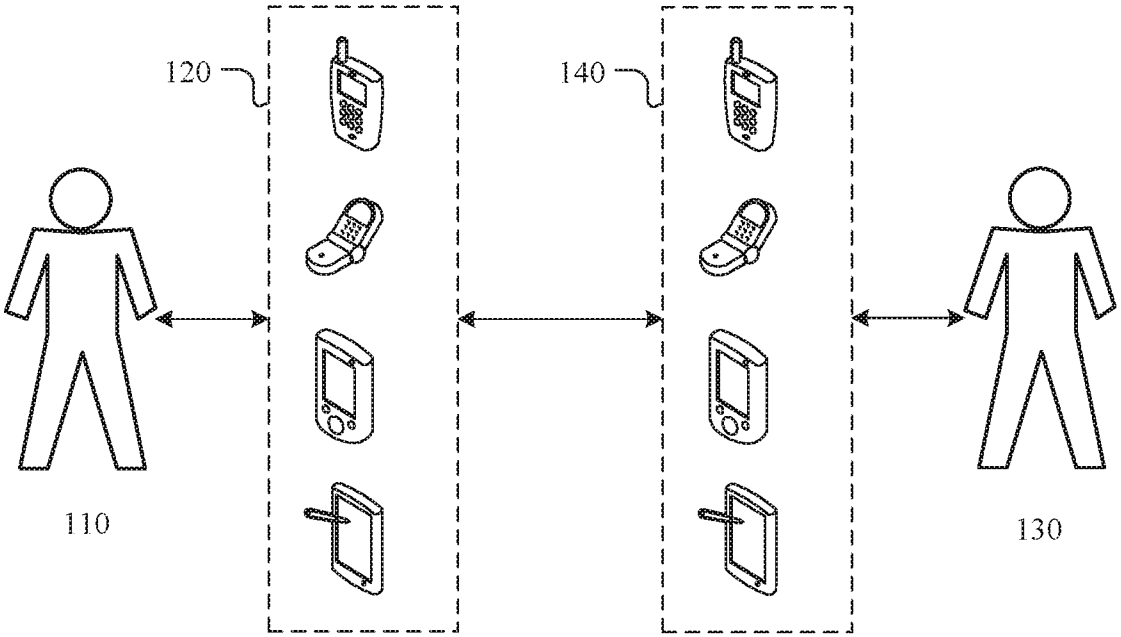
FIG. 1 illustrates an example first client computing device communicating with an example second client computing device.

FIG. 1 illustrates an example client computing device 130 communicating with an example client computing device 140. A client computing device may be any suitable computing device, such as a personal computer, a laptop computer, a cellular telephone, a smartphone, or a tablet computer. In particular embodiments, a client computing device may include a microphone or other sensor that may convert sounds into an electrical signal. In particular embodiments, a user may be an human user. A first client computing device may receive audio from a user and communicate data representing the audio to a second client computing device of another user. As an example and not by way of limitation, client computing device 120 may access an audio signal, such as the voice signal of user 110. In particular embodiments, an audio signal may be a digital audio signal (e.g., an audio signal encoded in digital form). Client computing device 120 may send data representing the audio to client computing device 140 of user 130. In particular embodiments, client computing device 120 may communicate with client computing device 140 through a network. A network may include an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, or a combination of two or more of these. Although FIG. 1 illustrates a particular arrangement of user 110, user 130, client computing device 120, and client computing device 140, this disclosure contemplates any suitable arrangement of user 110, user 130, client computing device 120, and client computing device 140. Moreover, although FIG. 1 illustrates a particular number of users 110, users 130, client computing devices 120, and client computing devices 140, this this disclosure contemplates any suitable number of users 110, users 130, client computing devices 120, and client computing devices 140.

Figure 2:
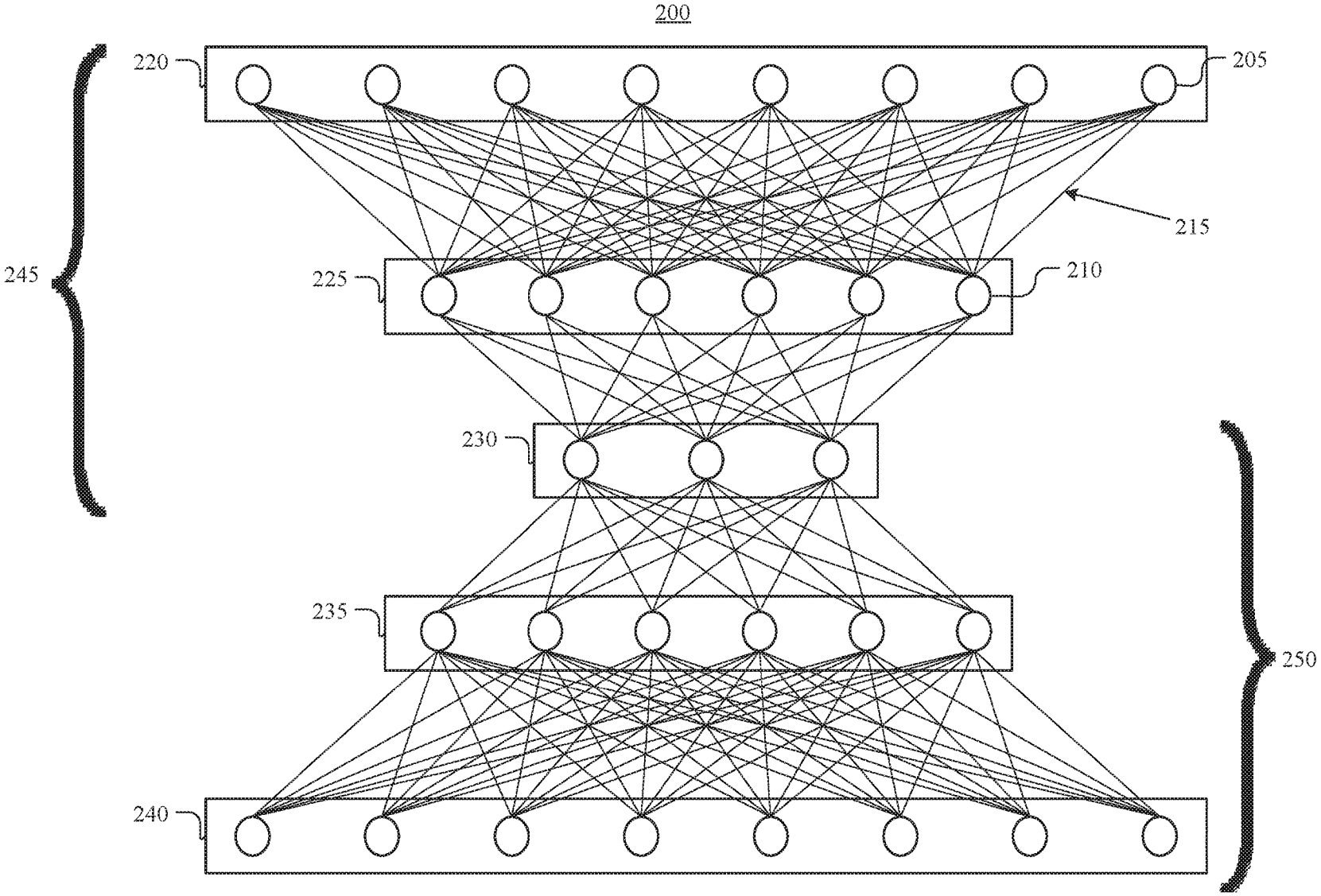
FIG. 2 illustrates an example artificial neural network ("ANN").

FIG. 2 illustrates an example artificial neural network ("ANN") 200. ANN 200 may comprise an input layer 220, hidden layers 225, 230, 235, and output layer 240. Hidden layer 230 may be a middle layer. Each layer of ANN 200 may comprise one or more nodes, such as node 205 or node 210. In particular embodiments, each node of a layer may be connected to one or more nodes of a previous or subsequent layer. As an example and not by way of limitation, each node of input layer 220 may be connected to one of more nodes of hidden layer 225. In particular embodiments, ANN 200 may comprise one or more bias nodes (e.g., a node in a layer that is not connected to and does not receive input from any node in a previous layer). Although FIG. 2 depicts a particular ANN with a particular number of layers, a particular number of nodes, and particular connections between nodes, this disclosure contemplates any suitable ANN with any suitable number of layers, any suitable number of nodes, and any suitable connections between nodes. As an example and not by way of limitation, although FIG. 2 depicts a connection between each node of input layer 220 and each node of hidden layer 225, one or more nodes of input layer 220 may not be connected to one or more nodes of hidden layer 225.

In particular embodiments, an activation function may correspond to each node of an ANN. An activation function of a node may define the output of a node for a given input. In particular embodiments, an input to a node may comprise a set of inputs. As an example and not by way of limitation, an activation function may be an identity function, a binary step function, a logistic function, or any other suitable function. As another example and not by way of limitation, an activation function for a node k may be the sigmoid function $$F_k(s_k) = \frac{1}{1 + e^{-s_k}}$$

or the hyperbolic tangent function $$F_k(s_k) = \frac{e^{s_k} - e^{-s_k}}{e^{s_k} + e^{-s_k}},$$

where $s_k$ may be the effective input to node k. In particular embodiments, the input of an activation function corresponding to a node may be weighted. Each node may generate output using a corresponding activation function based on weighted inputs. In particular embodiments, an ANN may be a feedforward ANN (e.g., an ANN with no cycles or loops where communication between nodes flows in one direction beginning with the input layer and proceeding to successive layers). As an example and not by way of limitation, the input to each node of hidden layer 225 may comprise the output of one or more nodes of input layer 220. As another example and not by way of limitation, the input to each node of output layer 240 may comprise the output of one or more nodes of hidden layer 235. In particular embodiments, each connection between nodes may be associated with a weight. As an example and not by way of limitation, connection 215 between node 205 and node 210 may have a weighting coefficient of 0.4, which may indicate that 0.4 multiplied by the output of node 205 is used as an input to node 210. As another example and not by way of limitation, the output $y_k$ of node k may be $y_k(t+1)=F_k(y_k(t), s_k(t))$, where $F_k$ may be the activation function corresponding to node k, $s_k(t)=\Sigma_j(w_{jk}(t)x_j(t)+b_k(t))$ may be the effective input to node k, $x_j(t)$ may be the output of a node j connected to node k, $w_{jk}$ may be the weighting coefficient between node j and node k, and $b_k$ may be an offset parameter. In particular embodiments, the input to nodes of the input layer may be based on the data input into the ANN. As an example and not by way of limitation, audio data may be input to ANN 200 and the input to nodes of input layer 220 may be based on feature selection of the audio data (e.g., loudness, pitch, brightness, duration, sampling frequency, etc.). Although this disclosure describes particular inputs to and outputs of nodes, this disclosure contemplates any suitable inputs to and outputs of nodes. Moreover, although this disclosure may describe particular connections and weights between nodes, this disclosure contemplates any suitable connections and weights between nodes.

In particular embodiments, an autoencoder may be an ANN used for unsupervised learning of encodings. The purpose of an autoencoder may be to output a reconstruction of its input. An autoencoder may be used to denoise data and create sparse representations of data. Autoencoders may be trained without supervision by using backpropagation to minimize the error between the input to the autoencoder and the output of the autoencoder. In particular embodiments, the ANN may be an autoencoder. Although this disclosure describes a particular autoencoder, this disclosure contemplates any suitable autoencoder.

In particular embodiments, a client computing device may initialize the ANN. As an example and not by way of limitation, ANN 200 may be initialized as an ANN comprising randomized weights. As another example and not by way of limitation, ANN 200 may be initialized as an ANN pre-trained to compress a voice signal (e.g., pre-trained to compress a voice signal in the Korean language, pre-trained to compress a voice signal of a male English speaker with a southern accent, pre-trained to compress a voice signal of a female Mandarin speaker with a Beijing accent, etc.). A pre-trained ANN may have been trained using exemplar voice signals from one or more other users. In particular embodiments, initializing an ANN using a pre-trained ANN may have the advantage of reducing the amount of time and computing resources required to sufficiently train an ANN. Although this disclosure may describe initializing an ANN in a particular manner, this disclosure contemplates initializing an ANN in any suitable manner.

In particular embodiments, the ANN may be trained to compress a user's voice. As an example and not by way of limitation, a voice signal of the user may be input to ANN 200. ANN 200 may compress the voice signal using the compression portion 245 of ANN 200 and decompress the compressed voice signal using the decompression portion 250 of ANN 200. The ANN 200 may be trained based on a comparison of the voice signal to the decompressed voice signal. In particular embodiments, a training method may be used to modify the weights associated with connections between nodes of the ANN to minimize an error between the voice signal and the decompressed voice signal. As an example and not by way of limitation, a training method such as the conjugate gradient method, the gradient descent method, the stochastic gradient descent may be used to backpropagate the sum-of-squares error between the voice signal and the decompressed voice signal (e.g., using a cost function that minimizes the sum-of-squares error). Although this disclosure may describe using particular training methods to train an ANN, this disclosure contemplates any suitable training method. Furthermore, although this disclosure describes compressing voice signals of users, this disclosure contemplates an ANN trained to compress any suitable data. As an example and not by way of limitation, an ANN may be trained to compress data representing music, an image, or any other suitable data.

In particular embodiments, the ANN may be trained to compress a user's voice and may compress a voice signal of the user using a compression portion of the ANN. An ANN may comprise an input layer, a middle layer, and an output layer. As an example and not by way of limitation, ANN 200 may comprise input layer 220, middle layer 230, and output layer 240. The middle layer of an ANN may be a hidden layer of the ANN which has the same number of hidden layers between the input layer and the middle layer and between the middle layer and the output layer. The compression portion of an ANN may comprise all layers between the input layer and the middle layer, inclusive. As an example and not by way of limitation, compression portion 245 of ANN 200 may comprise input layer 220, hidden layer 225, and middle layer 230. In particular embodiments, the middle layer of the ANN may comprise fewer nodes than any other layer of the ANN. As an example and not by way of limitation, middle layer 230 comprises fewer nodes than input layer 220, hidden layers 225, 235, and output layer 240. In particular embodiments, the compressed voice signal may comprise the output of the middle layer. As an example and not by way of limitation, a voice signal of a user may be input into ANN 200, and the compressed voice signal may comprise the output of middle layer 230. In particular embodiments, the compressed voice signal may have a lower file size than the voice signal, which may result in faster transmission of the voice signal, using less bandwidth to transmit the voice signal, or using less storage space to store the voice signal. Although this disclosure describes compressing a voice signal in a particular manner, this disclosure contemplates compressing a voice signal in any suitable manner.

In particular embodiments, a first client computing device may send the compressed voice signal to a second client computing device. The second client device may store or have access to the decompression portion of the ANN. The decompression portion of an ANN may comprise all layers of the ANN from the middle layer to the output layer, inclusive. As an example and not by way of limitation, decompression portion 250 of ANN 200 may comprise middle layer 230, hidden layer 235, and output layer 240. The second client device may use decompression portion 250 to decompress the compressed voice signal. The decompressed voice signal may be the output of output layer 240. The compressed voice signal, as the output of middle layer 230, may be the input of hidden layer 235. Although this disclosure describes sending a compressed a voice signal and decompressing a compressed voice signal in a particular manner, this disclosure contemplates sending a compressed a voice signal and decompressing a compressed voice signal in any suitable manner.

In particular embodiments, when a first user uses a first client computing device to begin a communication session with a second client computing device, the first client computing device may determine whether an ANN trained to compress the first user's voice is stored on or accessible by the first client computing device. If an ANN trained to compress the first user's voice is not accessible, then the first client computing device may initialize an ANN. The first client computing device may train the ANN to compress the user's voice using one or more voice signals of the user. While the ANN is being trained, the first client computing device may use a default voice-compression technique (e.g., μ-law or a-law) to compress and send voice signals. The first client computing device may determine that the ANN is sufficiently trained based on the error rate of the ANN. If the first client computing device determines that it had access to an ANN trained to compress the first user's voice, or if the first client computing device has initialized and trained an ANN to compress the first user's voice, then first client computing device may determine whether the second client computing device has access to the decompression portion of the ANN. If the second client computing device does not have access to the decompression portion, then the first client computing device may send the decompression portion to the first client computing device. After either determining that the second client computing device has access to the decompression portion or after sending the decompression portion, the first client computing device may compress the first user's voice using the ANN and send the compressed voice signals to the second client computing device. As an example and not by way of limitation, user Alice may use her mobile phone to call another mobile phone. Alice's mobile phone may determine that is does not have access to an ANN trained to compress Alice's voice. Alice's mobile phone may initialize an ANN and train the ANN to compress Alice's voice using Alice's voice signals made during the call. While the ANN is being trained, Alice's mobile phone may use the μ-law default voice-compression technique to compress and send voice signals. Once the error rate of the ANN is determined to be below a predetermined threshold, Alice's mobile phone may determine that the other mobile phone does not have access to the decompression portion of the ANN. Alice's mobile phone may send the decompression portion to the other mobile phone. Alice's phone may then begin compressing Alice's voice signals using the ANN and sending the compressed voice signals to the other mobile phone. Although this disclosure may describe training an ANN and compressing voice signals in a particular manner, this disclosure contemplates training an ANN and compressing voice signals in any suitable manner.

In particular embodiments, the first client computing device may monitor the error rate of the ANN. In particular embodiments, when the error rate exceeds a predetermined threshold, the first client computing device may at least temporarily discontinue the use of the ANN to compress the first user's voice and use a default voice-compression technique to compress the first user's voice. As an example and not by way of limitation, Alice may use her mobile phone to call another mobile phone. Alice's phone may be using an ANN trained to compress her voice to send compressed voice signals to the other mobile phone. Alice may have laryngitis, and as a result, Alice's vocal cords may be inflamed and Alice's voice may be unusually hoarse. The ANN may have been trained using only voice signals from Alice's regular speaking voice. As Alice speaks into her mobile phone, the mobile phone may detect that an error rate of the ANN has exceeded a predetermined threshold. In response to detecting that the error rate has exceeded a predetermined threshold, Alice's mobile phone may at least temporarily discontinue using the ANN and instead use a default voice-compression technique. Alice may recover from laryngitis and her speaking voice may return to normal, or the ANN may be trained using voice signals from Alice while she has laryngitis. Alice's mobile phone may detect that an error rate is less than the predetermined threshold, and in response, may discontinue use of the default voice-compression technique and resume using the ANN to compress Alice's voice. Although this disclosure may describe detecting an error rate of an ANN and at least temporarily discontinuing using the ANN and using a default voice-compression technique in a particular manner, this disclosure contemplates detecting an error rate of an ANN and at least temporarily discontinuing using the ANN and using a default voice-compression technique in any suitable manner.

In particular embodiments, the error rate of an ANN may be calculated based on a comparison of a voice signal to a decompressed voice signal. The ANN may compress the voice signal using a compression portion of the ANN. The ANN may decompress the compressed voice signal using a decompression portion of the ANN. The error rate may be determined by comparing the voice signal to the decompressed voice signal. As an example and not by way of limitation, the error rate may be a sum-of-squares error between the voice signal and the decompressed voice signal. As another example and not by way of limitation, the error rate may be a sum of absolute deviation between the voice signal and the decompressed voice signal. In particular embodiments, the error rate of the ANN may be updated as the client computing device accesses voice signals (e.g., the error rate may be recalculated as voice signals are accessed). Although this disclosure describes calculating error of an ANN in a particular manner, this disclosure contemplates calculating error of an ANN in any suitable manner.

In particular embodiments, an ANN trained to compress the voice of a first user may be trained to compress the voice of a second user. The first client computing device may access a voice signal from a second user. The ANN may compress the voice signal from the second user using the compression portion of the ANN. The first client computing device may send the compressed voice signal from the second user to a second client computing device. Although this disclosure may describe a particular ANN trained to compress the voice of a first user and a second user, this disclosure contemplates any suitable ANN trained to compress the voice of a first user and a second user.

In particular embodiments, a first client computing device may use a plurality of ANNs to compress the voice of a plurality of respective users. A first client computing device may store or have access to an ANN trained to compress the voice of a first user. The first client computing device may also store or have access to another ANN trained to compress the voice of a second user. The first client computing device may access a voice signal from the second user. The first client computing device may compress the voice signal from the second user using the other ANN trained to compress the voice of a second user. In particular embodiments, a first client computing device that may access an ANN trained to compress the first user's voice and the other ANN trained to compress the second user's voice may determine whether a voice signal is from the first user or the second user. If the voice signal is from the first user, the ANN may compress the voice signal using the ANN trained to compress the first user's voice. If the voice signal is from the second user, the ANN may compress the voice signal using the other ANN trained to compress the second user's voice. Although this disclosure may describe a particular ANN trained to compress the voice of a first user and another particular ANN trained to compress the voice of a second user, this disclosure contemplates any suitable ANN trained to compress the voice of a first user and any other suitable ANN trained to compress the voice of a second user.

In particular embodiments, the first client computing device may receive from the second client computing device a compressed voice signal from a second user. The compressed voice signal from the second user may have been compressed using another compression portion of another ANN trained to compress the second user's voice. The first client computing device may decompress the voice signal from the second user using another decompression portion of the other ANN. In particular embodiments the other decompression portion of the other ANN may be sent from the second client computing device to the first client computing device. Although this disclosure described decompressing a voice signal in a particular manner, this disclosure contemplates decompressing a voice signal in any suitable manner.

In particular embodiments, the ANN may be trained to generate a decompressed voice signal that is an alteration of the input voice signal. As an example and not by way of limitation, the ANN may be trained to reduce the noise of a voice signal by using a noise reduction technique (e.g., using a dynamic noise limiter, a time-frequency filter, or any other suitable noise reduction technique). As another example and not by way of limitation, the ANN may be trained to alter the voice signal by changing the tone or pitch of the voice signal, adding distortion to the voice signal, or by altering the voice signal in any suitable manner. Although this disclosure describes altering a voice signal in a particular manner, this disclosure contemplates altering a voice signal in any suitable manner.

Figure 3:
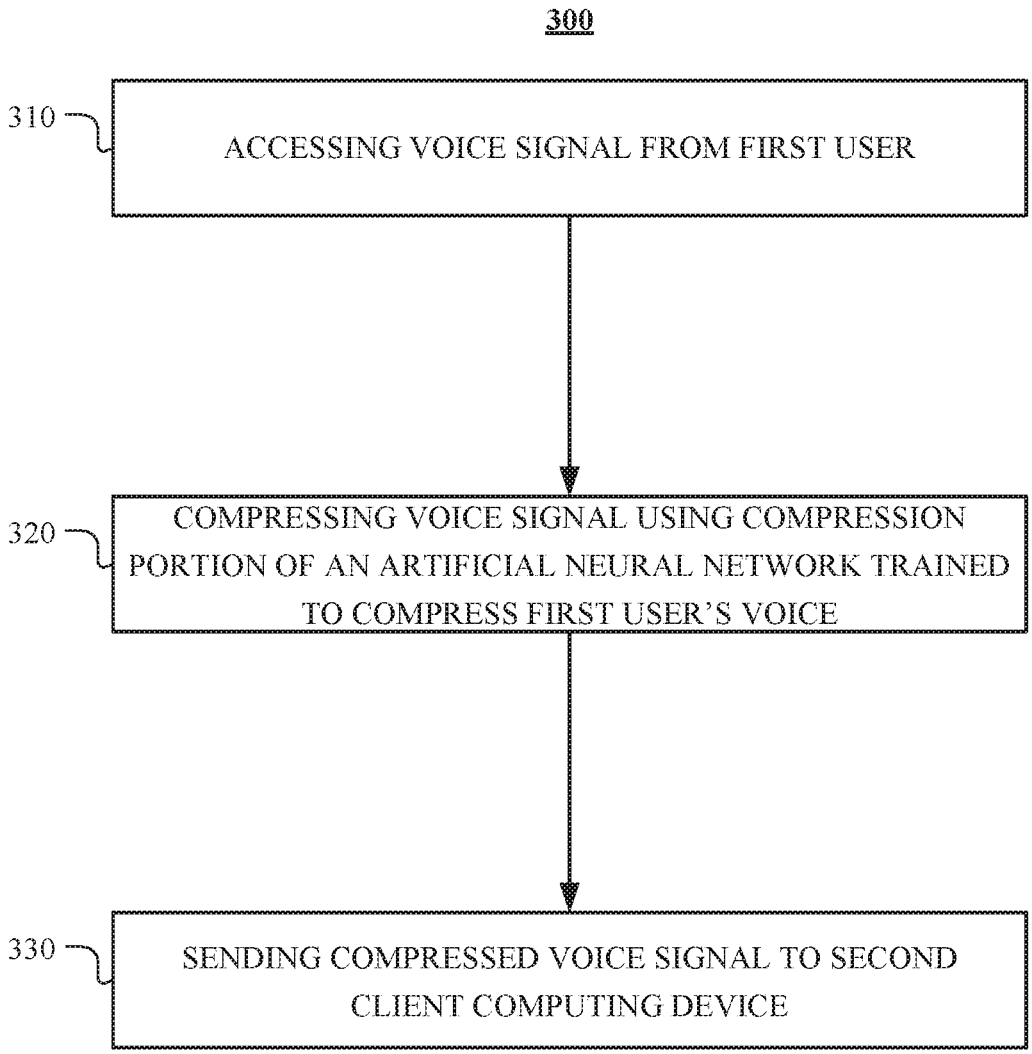
FIG. 3 illustrates an example method for compressing a voice signal using an ANN.

FIG. 3 illustrates an example method 300 for compressing a voice signal using an ANN. The method may begin at step 310, where the first client computing device may access a voice signal from the first user. At step 320, the client computing device may compress the voice signal using a compression portion of an ANN trained to compress the first user's voice. At step 330, the first client computing device may send the compressed voice signal to a second client computing device. Particular embodiments may repeat one or more steps of the method of FIG. 3, where appropriate. Although this disclosure describes and illustrates particular steps of the method of FIG. 3 as occurring in a particular order, this disclosure contemplates any suitable steps of the method of FIG. 3 occurring in any suitable order. Moreover, although this disclosure describes and illustrates an example method for compressing a voice signal using an ANN including the particular steps of the method of FIG. 3, this disclosure contemplates any suitable method for compressing a voice signal using an ANN including any suitable steps, which may include all, some, or none of the steps of the method of FIG. 3, where appropriate. Furthermore, although this disclosure describes and illustrates particular components, devices, or systems carrying out particular steps of the method of FIG. 3, this disclosure contemplates any suitable combination of any suitable components, devices, or systems carrying out any suitable steps of the method of FIG. 3.

Figure 4:
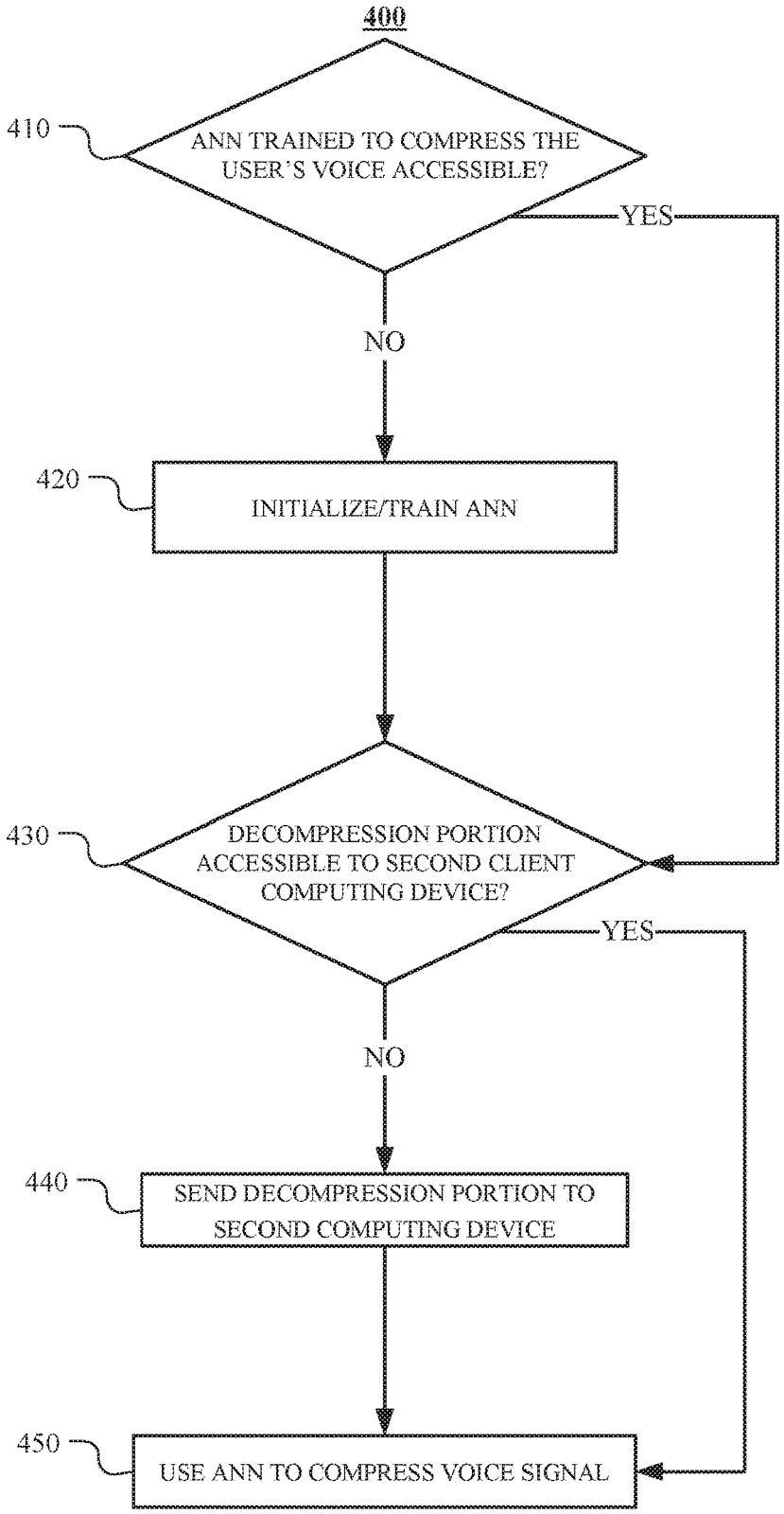
FIG. 4 illustrates an example method for using an ANN to send a compressed voice signal from a client computing device.

FIG. 4 illustrates an example method 400 for using an ANN to send a compressed voice signal from a first client computing device. The method may begin at step 410, where the first client computing device may determine if it has access to an ANN trained to compress the first user's voice. If the first client computing device does not have access to an ANN trained to compress the first user's voice, method may proceed to step 420. At step 420, the first client computing device may initialize an ANN and train the ANN to compress the first user's voice. If the first client computing device does have access to an ANN trained to compress the first user's voice, the method may continue at step 430. At step 430, the first client computing device may determine whether the second client computing device has access to a decompression portion of the ANN trained to compress the first user's voice. If the second client computing device does not have access to a decompression portion of the ANN trained to compress the first user's voice, the method may proceed to step 440. At step 440, the first client computing device may send the decompression portion of the ANN to the second client computing device. At step 450, the first client computing device may use the ANN to compress the voice signal of the first user and send the compressed voice signal to the second client computing device. Particular embodiments may repeat one or more steps of the method of FIG. 4, where appropriate. Although this disclosure describes and illustrates particular steps of the method of FIG. 4 as occurring in a particular order, this disclosure contemplates any suitable steps of the method of FIG. 4 occurring in any suitable order. Moreover, although this disclosure describes and illustrates an example method for using an ANN to send a compressed voice signal from a first client computing device including the particular steps of the method of FIG. 4, this disclosure contemplates any suitable method for using an ANN to send a compressed voice signal from a first client computing device including any suitable steps, which may include all, some, or none of the steps of the method of FIG. 4, where appropriate. Furthermore, although this disclosure describes and illustrates particular components, devices, or systems carrying out particular steps of the method of FIG. 4, this disclosure contemplates any suitable combination of any suitable components, devices, or systems carrying out any suitable steps of the method of FIG. 4.

Figure 5:
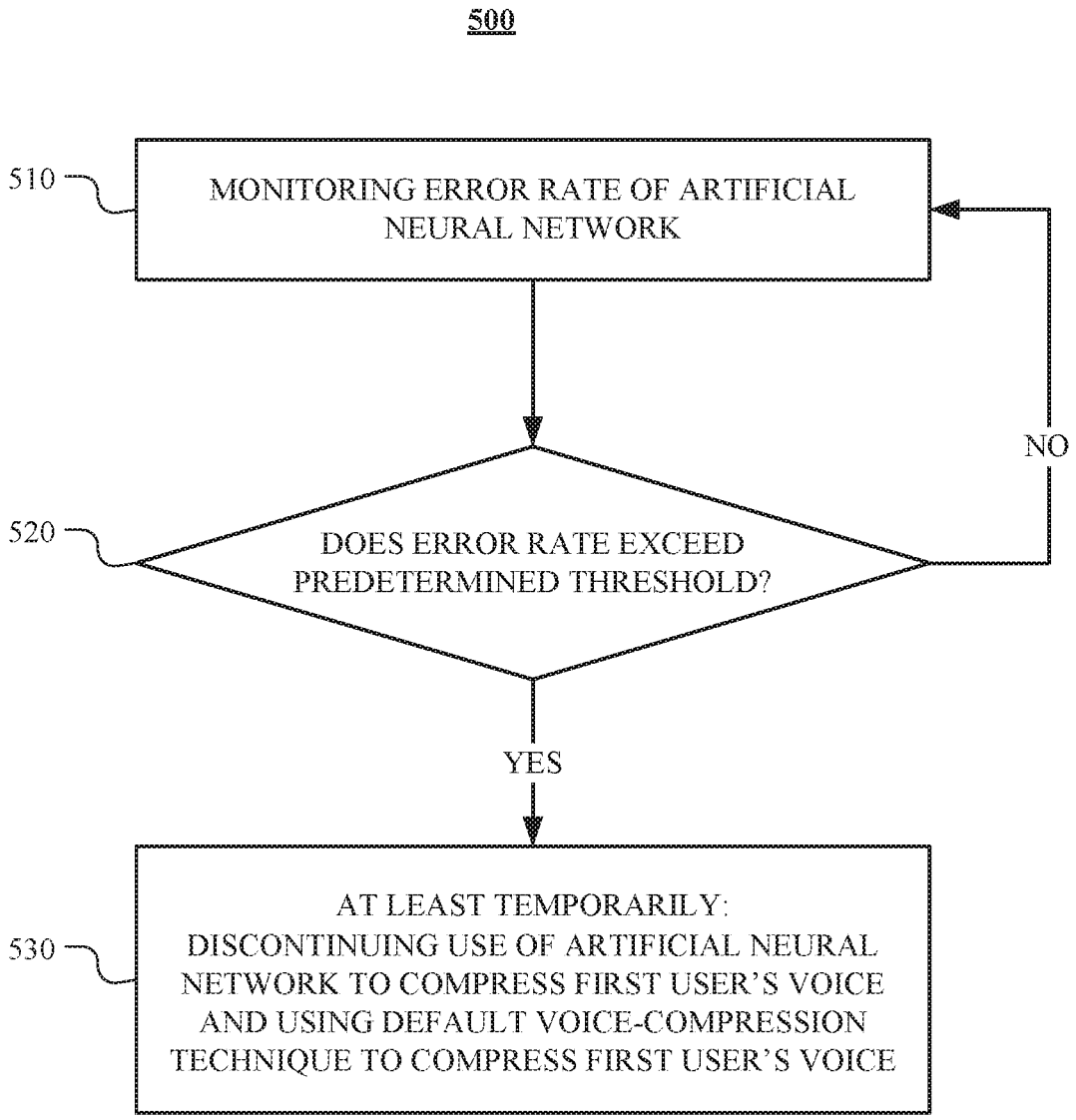
FIG. 5 illustrates an example method for at least temporarily discontinuing use of an ANN to compress voice.

FIG. 5 illustrates an example method 500 for at least temporarily discontinuing use of an ANN to compress voice. The method may begin at step 510, where the first client computing device may monitor the error rate of the ANN. At step 520, the first client computing device may determine whether the error rate exceeds a predetermined threshold. If the error rate does not exceed a predetermined threshold, the method may continue to monitor the error rate at step 510. If the error rate exceeds a predetermined threshold, the method may continue at step 530. At step 530, the first client computing device may at least temporarily discontinue use of the ANN to compress the first user's voice and use a default voice-compression technique to compress the first user's voice. Particular embodiments may repeat one or more steps of the method of FIG. 5, where appropriate. Although this disclosure describes and illustrates particular steps of the method of FIG. 5 as occurring in a particular order, this disclosure contemplates any suitable steps of the method of FIG. 5 occurring in any suitable order. Moreover, although this disclosure describes and illustrates an example method for at least temporarily discontinuing use of an ANN to compress voice including the particular steps of the method of FIG. 5, this disclosure contemplates any suitable method for at least temporarily discontinuing use of an ANN to compress voice including any suitable steps, which may include all, some, or none of the steps of the method of FIG. 5, where appropriate. Furthermore, although this disclosure describes and illustrates particular components, devices, or systems carrying out particular steps of the method of FIG. 5, this disclosure contemplates any suitable combination of any suitable components, devices, or systems carrying out any suitable steps of the method of FIG. 5.

Figure 6:
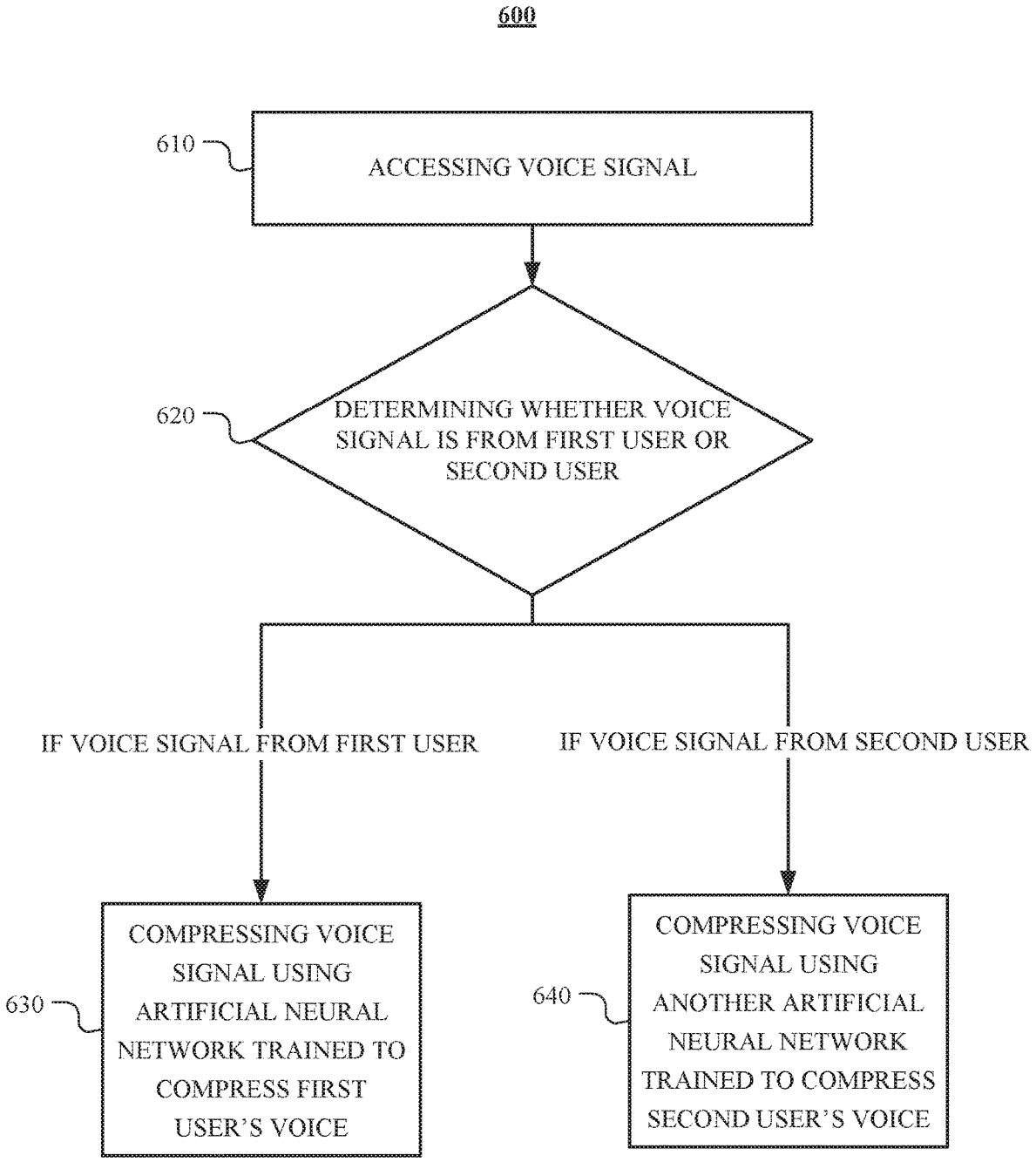
FIG. 6 illustrates an example method for determining an ANN to use to compress a voice signal.

FIG. 6 illustrates an example method 600 for determining an ANN to use to compress a voice signal. The method may begin at step 610, where the first client computing device may access a voice signal. At step 620, the first client computing device may determine whether the voice signal is from a first user or a second user. If the voice signal is from the first user, the method may continue to step 630. At step 630, the first client computing device may compress the voice signal using the ANN trained to compress the first user's voice. If the voice signal is from the second user, the method may continue to step 640. At step 640, the first client computing device may compress the voice signal using the other ANN trained to compress the second user's voice. Particular embodiments may repeat one or more steps of the method of FIG. 6, where appropriate. Although this disclosure describes and illustrates particular steps of the method of FIG. 6 as occurring in a particular order, this disclosure contemplates any suitable steps of the method of FIG. 6 occurring in any suitable order. Moreover, although this disclosure describes and illustrates an example method for determining an ANN to use to compress a voice signal including the particular steps of the method of FIG. 6, this disclosure contemplates any suitable method for determining an ANN to use to compress a voice signal including any suitable steps, which may include all, some, or none of the steps of the method of FIG. 6, where appropriate. Furthermore, although this disclosure describes and illustrates particular components, devices, or systems carrying out particular steps of the method of FIG. 6, this disclosure contemplates any suitable combination of any suitable components, devices, or systems carrying out any suitable steps of the method of FIG. 6.

Figure 7:
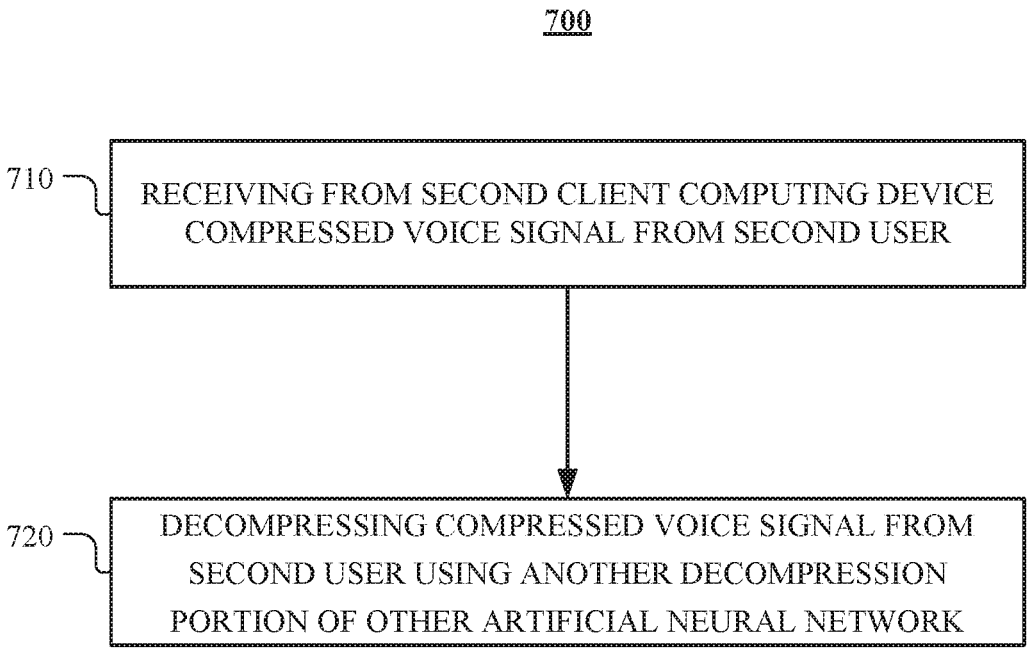
FIG. 7 illustrates an example method for decompressing a compressed voice signal.

FIG. 7 illustrates an example method 700 for decompressing a compressed voice signal. The method may begin at step 710, where the first client computing device may receive a compressed voice signal from a second user from a second client computing device. At step 720, the first client computing device may decompress the compressed voice signal from the second user using another decompression portion of the other ANN. Particular embodiments may repeat one or more steps of the method of FIG. 7, where appropriate. Although this disclosure describes and illustrates particular steps of the method of FIG. 7 as occurring in a particular order, this disclosure contemplates any suitable steps of the method of FIG. 7 occurring in any suitable order. Moreover, although this disclosure describes and illustrates an example method for decompressing a compressed voice signal including the particular steps of the method of FIG. 7, this disclosure contemplates any suitable method for decompressing a compressed voice signal including any suitable steps, which may include all, some, or none of the steps of the method of FIG. 7, where appropriate. Furthermore, although this disclosure describes and illustrates particular components, devices, or systems carrying out particular steps of the method of FIG. 7, this disclosure contemplates any suitable combination of any suitable components, devices, or systems carrying out any suitable steps of the method of FIG. 7.

Figure 8:
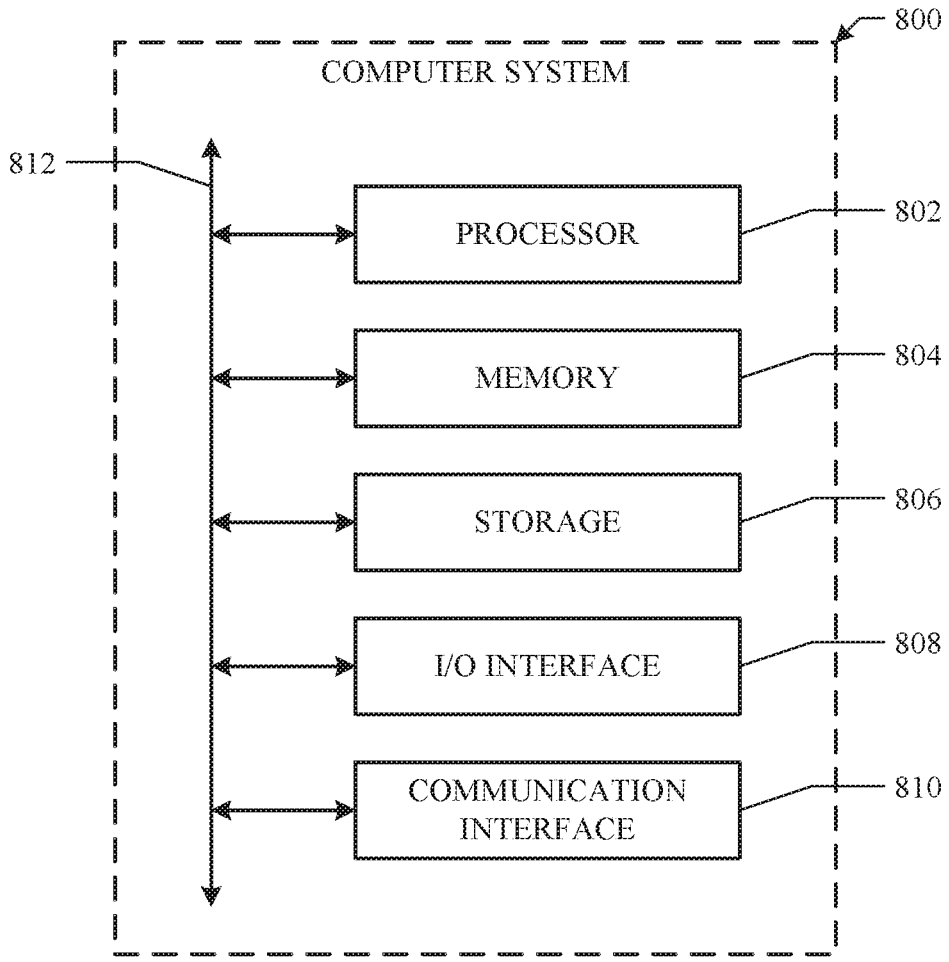
FIG. 8 illustrates an example computer system.

FIG. 8 illustrates an example computer system 800. In particular embodiments, one or more computer systems 800 perform one or more steps of one or more methods described or illustrated herein. In particular embodiments, one or more computer systems 800 provide functionality described or illustrated herein. In particular embodiments, software running on one or more computer systems 800 performs one or more steps of one or more methods described or illustrated herein or provides functionality described or illustrated herein. Particular embodiments include one or more portions of one or more computer systems 800. Herein, reference to a computer system may encompass a computing device, and vice versa, where appropriate. Moreover, reference to a computer system may encompass one or more computer systems, where appropriate.

This disclosure contemplates any suitable number of computer systems 800. This disclosure contemplates computer system 800 taking any suitable physical form. As example and not by way of limitation, computer system 800 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 800 may include one or more computer systems 800; be unitary or distributed; span multiple locations; span multiple machines; span multiple data centers; or reside in a cloud, which may include one or more cloud components in one or more networks. Where appropriate, one or more computer systems 800 may perform without substantial spatial or temporal limitation one or more steps of one or more methods described or illustrated herein. As an example and not by way of limitation, one or more computer systems 800 may perform in real time or in batch mode one or more steps of one or more methods described or illustrated herein. One or more computer systems 800 may perform at different times or at different locations one or more steps of one or more methods described or illustrated herein, where appropriate.

In particular embodiments, computer system 800 includes a processor 802, memory 804, storage 806, an input/output (I/O) interface 808, a communication interface 810, and a bus 812. Although this disclosure describes and illustrates a particular computer system having a particular number of particular components in a particular arrangement, this disclosure contemplates any suitable computer system having any suitable number of any suitable components in any suitable arrangement.

In particular embodiments, processor 802 includes hardware for executing instructions, such as those making up a computer program. As an example and not by way of limitation, to execute instructions, processor 802 may retrieve (or fetch) the instructions from an internal register, an internal cache, memory 804, or storage 806; decode and execute them; and then write one or more results to an internal register, an internal cache, memory 804, or storage 806. In particular embodiments, processor 802 may include one or more internal caches for data, instructions, or addresses. This disclosure contemplates processor 802 including any suitable number of any suitable internal caches, where appropriate. As an example and not by way of limitation, processor 802 may include one or more instruction caches, one or more data caches, and one or more translation lookaside buffers (TLBs). Instructions in the instruction caches may be copies of instructions in memory 804 or storage 806, and the instruction caches may speed up retrieval of those instructions by processor 802. Data in the data caches may be copies of data in memory 804 or storage 806 for instructions executing at processor 802 to operate on; the results of previous instructions executed at processor 802 for access by subsequent instructions executing at processor 802 or for writing to memory 804 or storage 806; or other suitable data. The data caches may speed up read or write operations by processor 802. The TLBs may speed up virtual-address translation for processor 802. In particular embodiments, processor 802 may include one or more internal registers for data, instructions, or addresses. This disclosure contemplates processor 802 including any suitable number of any suitable internal registers, where appropriate. Where appropriate, processor 802 may include one or more arithmetic logic units (ALUs); be a multi-core processor; or include one or more processors 802. Although this disclosure describes and illustrates a particular processor, this disclosure contemplates any suitable processor.

In particular embodiments, memory 804 includes main memory for storing instructions for processor 802 to execute or data for processor 802 to operate on. As an example and not by way of limitation, computer system 800 may load instructions from storage 806 or another source (such as, for example, another computer system 800) to memory 804. Processor 802 may then load the instructions from memory 804 to an internal register or internal cache. To execute the instructions, processor 802 may retrieve the instructions from the internal register or internal cache and decode them. During or after execution of the instructions, processor 802 may write one or more results (which may be intermediate or final results) to the internal register or internal cache. Processor 802 may then write one or more of those results to memory 804. In particular embodiments, processor 802 executes only instructions in one or more internal registers or internal caches or in memory 804 (as opposed to storage 806 or elsewhere) and operates only on data in one or more internal registers or internal caches or in memory 804 (as opposed to storage 806 or elsewhere). One or more memory buses (which may each include an address bus and a data bus) may couple processor 802 to memory 804. Bus 812 may include one or more memory buses, as described below. In particular embodiments, one or more memory management units (MMUs) reside between processor 802 and memory 804 and facilitate accesses to memory 804 requested by processor 802. In particular embodiments, memory 804 includes random access memory (RAM). This RAM may be volatile memory, where appropriate Where appropriate, this RAM may be dynamic RAM (DRAM) or static RAM (SRAM). Moreover, where appropriate, this RAM may be single-ported or multi-ported RAM. This disclosure contemplates any suitable RAM. Memory 804 may include one or more memories 804, where appropriate.

Although this disclosure describes and illustrates particular memory, this disclosure contemplates any suitable memory.

In particular embodiments, storage 806 includes mass storage for data or instructions. As an example and not by way of limitation, storage 806 may include a hard disk drive (HDD), a floppy disk drive, flash memory, an optical disc, a magneto-optical disc, magnetic tape, or a Universal Serial Bus (USB) drive or a combination of two or more of these. Storage 806 may include removable or non-removable (or fixed) media, where appropriate. Storage 806 may be internal or external to computer system 800, where appropriate. In particular embodiments, storage 806 is non-volatile, solid-state memory. In particular embodiments, storage 806 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 806 taking any suitable physical form. Storage 806 may include one or more storage control units facilitating communication between processor 802 and storage 806, where appropriate. Where appropriate, storage 806 may include one or more storages 806. Although this disclosure describes and illustrates particular storage, this disclosure contemplates any suitable storage.

In particular embodiments, I/O interface 808 includes hardware, software, or both, providing one or more interfaces for communication between computer system 800 and one or more I/O devices. Computer system 800 may include one or more of these I/O devices, where appropriate. One or more of these I/O devices may enable communication between a person and computer system 800. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 808 for them. Where appropriate, I/O interface 808 may include one or more device or software drivers enabling processor 802 to drive one or more of these I/O devices. I/O interface 808 may include one or more I/O interfaces 808, where appropriate. Although this disclosure describes and illustrates a particular I/O interface, this disclosure contemplates any suitable I/O interface.

In particular embodiments, communication interface 810 includes hardware, software, or both providing one or more interfaces for communication (such as, for example, packet-based communication) between computer system 800 and one or more other computer systems 800 or one or more networks. As an example and not by way of limitation, communication interface 810 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 810 for it. As an example and not by way of limitation, computer system 800 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 800 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 800 may include any suitable communication interface 810 for any of these networks, where appropriate. Communication interface 810 may include one or more communication interfaces 810, where appropriate. Although this disclosure describes and illustrates a particular communication interface, this disclosure contemplates any suitable communication interface.

In particular embodiments, bus 812 includes hardware, software, or both coupling components of computer system 800 to each other. As an example and not by way of limitation, bus 812 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 812 may include one or more buses 812, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

The invention claimed is:

1. A method comprising:

by a first client computing device, establishing a communication session to a second client computing device;

by the first client computing device, accessing a first audio signal;

by the first client computing device, compressing the first audio signal using a compression portion of a first artificial neural network particularly trained to compress a first user's voice using one or more voice signals of the first user, wherein:

the first artificial neural network is generated during the communication session when an artificial neural network customized to the first user is unavailable;

the first artificial neural network comprises an input layer, a middle layer, and an output layer;

the compression portion of the first artificial neural network comprises all layers of the first artificial neural network between the input layer of the first artificial neural network and the middle layer of the first artificial neural network, inclusive;

each layer of the first artificial neural network comprises one or more nodes;

the middle layer of the first artificial neural network comprises fewer nodes than any other layer of the first artificial neural network; and a first compressed audio signal based on the first audio signal comprises an output of the middle layer of the first artificial neural network;

by the first client computing device, sending the first compressed audio signal to the second client computing device, wherein:

a decompression portion of the first artificial neural network is stored on the second client computing device, wherein, when the first artificial neural network was generated during the communication session, the decompression portion of the first artificial neural network is sent to the second client computing device during the communication session; and the decompression portion of the first artificial neural network stored on the second client computing device comprises all layers of the first artificial neural network between the middle layer of the first artificial neural network and the output layer of the first artificial neural network, inclusive;

by the first client computing device, receiving from the second client computing device a second compressed audio signal, wherein the second compressed audio signal was compressed using a compression portion of a second artificial neural network separately trained to compress a second user's voice using one or more voice signals of the second user; and by the first client computing device, decompressing the second compressed audio signal using a decompression portion of the second artificial neural network stored on the first client computing device, wherein:

the second artificial neural network comprises an input layer, a middle layer, and an output layer;

the decompression portion of the second artificial neural network comprises all layers of the second artificial neural network between the middle layer of the second artificial neural network and the output layer of the second artificial neural network, inclusive;

each layer of the second artificial neural network comprises one or more nodes;

the middle layer of the second artificial neural network comprises fewer nodes than any other layer of the second artificial neural network; and a decompressed audio signal based on a second audio signal comprises an output of the output layer of the second artificial neural network.

2. The method of claim 1, further comprising:

by the first client computing device, monitoring an error rate of the first artificial neural network; and when the error rate exceeds a predetermined threshold, then at least temporarily:

discontinuing use of the first artificial neural network to compress the first audio signal; and using a default compression technique to compress the first audio signal.

3. The method of claim 2, wherein the error rate of the first artificial neural network is determined by:

compressing another audio signal using the compression portion of the first artificial neural network;

decompressing the compressed other audio signal using the decompression portion of the first artificial neural network; and comparing the decompressed other audio signal to the other audio signal.

4. The method of claim 2, wherein the error rate of the first artificial neural network is determined by:

compressing another audio signal using the compression portion of the first artificial neural network;

decompressing the compressed other audio signal using the decompression portion of the first artificial neural network;

processing the other audio signal with a desired audio filter; and comparing the decompressed audio signal to the processed other audio signal.

5. The method of claim 1, further comprising:

by the first client computing device, accessing a third audio signal;

by the first client computing device, compressing the third audio signal using the compression portion of the first artificial neural network, wherein the first artificial neural network is further particularly trained to compress a third user's voice using one or more voice signals of the third user; and by the first client computing device, sending to the second client computing device the compressed third audio signal.

6. The method of claim 1, further comprising:

by the first client computing device, accessing a third audio signal;

by the first client computing device, compressing the third audio signal using a compression portion of a third artificial neural network particularly trained to compress a third user's voice using one or more voice signals of the third user, wherein:

the third artificial neural network comprises an input layer, a middle layer, and an output layer;

the compression portion of the third artificial neural network comprises all layers of the third artificial neural network between the input layer of the third artificial neural network and the middle layer of the third artificial neural network, inclusive;

each layer of the third artificial neural network comprises one or more nodes;

the middle layer of the third artificial neural network comprises fewer nodes than any other layer of the third artificial neural network; and a third compressed third audio signal based on the third audio signal comprises an output of the middle layer of the third artificial neural network; and by the first client computing device, sending to the second client computing device the third compressed audio signal.

7. The method of claim 6 further comprising:

by the first client computing device, accessing an audio signal;

by the first client computing device, determining whether the audio corresponds to the first audio signal or the third audio signal; and when the audio signal corresponds to the first audio signal, compressing the audio signal using the first artificial neural network; and when the audio signal corresponds to the third audio signal, compressing the audio signal using the third artificial neural network.

8. The method of claim 1, wherein the first artificial neural network is trained such that the output of the decompression portion of the first artificial neural network is the first audio signal with an audible audio signal alteration.

9. The method of claim 1, further comprising:

determining that the artificial neural network customized to the first user is unavailable by determining that the artificial neural network customized to the first user is not stored on or accessible to the first client computing device.

10. The method of claim 1, further comprising:

determining that the artificial neural network customized to the first user is unavailable by comparing an error rate of the artificial neural network customized to the first user to a predetermined threshold to determine that the first artificial neural network is not sufficiently trained.

11. One or more computer-readable non-transitory storage media embodying software that is operable when executed to:

at a first client computing device, establishing a communication session to a second client computing device;

at the first client computing device, access a first audio signal;

at the first client computing device, compress the first audio signal using a compression portion of a first artificial neural network particularly trained to compress a first user's voice using one or more voice signals of the first user, wherein:

the first artificial neural network is generated during the communication session when an artificial neural network customized to the first user is unavailable;

the artificial neural network comprises an input layer, a middle layer, and an output layer;

the compression portion of the first artificial neural network comprises all layers of the first artificial neural network between the input layer of the first artificial neural network and the middle layer of the first artificial neural network, inclusive;

each layer of the artificial neural network comprises one or more nodes;

the middle layer of the first artificial neural network comprises fewer nodes than any other layer of the first artificial neural network; and a first compressed audio signal based on the first audio signal comprises an output of the middle layer of the first artificial neural network;

at the first client computing device, send the first compressed audio signal to the second client computing device, wherein:

a decompression portion of the first artificial neural network is stored on the second client computing device, wherein, when the first artificial neural network was generated during the communication session, the decompression portion of the first artificial neural network is sent to the second client computing device during the communication session; and the decompression portion of the first artificial neural network stored on the second client computing device comprises all layers of the first artificial neural network between the middle layer of the first artificial neural network and the output layer of the first artificial neural network, inclusive;

at a first client computing device, receive from the second client computing device a second compressed audio signal from a second user, wherein the second compressed audio signal was compressed using a compression portion of a second artificial neural network separately trained to compress a second user's voice using one or more voice signals of the second user; and at the first client computing device, decompress the second compressed audio signal using a decompression portion of the second artificial neural network stored on the first client computing device, wherein:

the second artificial neural network comprises an input layer, a middle layer, and an output layer;

the decompression portion of the second artificial neural network comprises all layers of the second artificial neural network between the middle layer of the second artificial neural network and the output layer of the second artificial neural network, inclusive;

each layer of the second artificial neural network comprises one or more nodes;

the middle layer of the second artificial neural network comprises fewer nodes than any other layer of the second artificial neural network; and a decompressed audio signal based on a second audio signal comprises an output of the output layer of the second artificial neural network.

12. The media of claim 11, wherein the software is further operable when executed to:

at the first client computing device, monitor an error rate of the first artificial neural network; and when the error rate exceeds a predetermined threshold, then at least temporarily:

discontinue use of the first artificial neural network to compress the first audio signal; and use a default compression technique to compress the first audio signal.

13. The media of claim 12, wherein the error rate of the first artificial neural network is determined by:

compressing another audio signal from using the compression portion of the first artificial neural network;

decompressing the compressed other audio signal user using the decompression portion of the first artificial neural network; and comparing the decompressed audio signal to the other audio signal.

14. The media of claim 11, wherein the software is further operable when executed to:

at the first client computing device, access a third audio signal;

at the first client computing device, compress the third audio signal using the compression portion of the first artificial neural, wherein the first artificial neural network is further particularly trained to compress a third user's voice using one or more voice signals of the third user; and at the first client computing device, send to the second client computing device the compressed third audio signal.

15. The media of claim 11, wherein the software is further operable when executed to:

at the first client computing device, access a third audio signal;

at the first client computing device, compress the third audio signal using a compression portion of a third artificial neural network particularly trained to compress a third user's voice using one or more voice signals of the third user, wherein:

the third artificial neural network comprises an input layer, a middle layer, and an output layer;

the compression portion of the third artificial neural network comprises all layers of the other artificial neural network between the input layer of the third artificial neural network and the middle layer of the third artificial neural network, inclusive;

each layer of the third artificial neural network comprises one or more nodes;

the middle layer of the third artificial neural network comprises fewer nodes than any other layer of the third artificial neural network; and the compressed audio signal comprises an output of the middle layer of the third artificial neural network; and at the first client computing device, send to the second client computing device the compressed third audio signal.

16. The media of claim 15, wherein the software is further operable when executed to:

at the first client computing device, access an audio signal;

at the first client computing device, determine whether the audio signal corresponds to the first audio signal or the third audio signal; and when the audio signal corresponds to the first audio signal, compress the audio signal using the first artificial neural network; and when the audio signal corresponds to the third audio signal, compress the audio signal using the third artificial neural network.

17. A system comprising:

one or more processors at a first client computing device; and a memory at the first client computing device coupled to the processors and comprising instructions operable when executed by the processors to cause the processors to:

establish a communication session to a second client computing device;

access a first audio signal;

compress the first audio signal using a compression portion of a first artificial neural network particularly trained to compress a first user's voice using one or more voice signals of the first user, wherein:

the first artificial neural network is generated during the communication session when an artificial neural network customized to the first user is unavailable;

the first artificial neural network comprises an input layer, a middle layer, and an output layer;

the compression portion of the first artificial neural network comprises all layers of the first artificial neural network between the input layer of the first artificial neural network and the middle layer of the first artificial neural network, inclusive;

each layer of the first artificial neural network comprises one or more nodes;

the middle layer of the first artificial neural network comprises fewer nodes than any other layer of the first artificial neural network; and a first compressed audio signal comprises an output of the middle layer of the first artificial neural network;

send the compressed audio signal based on the first audio signal to the second client computing device, wherein:

a decompression portion of the first artificial neural network is stored on the second client computing device, wherein, when the first artificial neural network was generated during the communication session, the decompression portion of the first artificial neural network is sent to the second client computing device during the communication session; and the decompression portion of the first artificial neural network stored on the second client computing device comprises all layers of the first artificial neural network between the middle layer of the first artificial neural network and the output layer of the first artificial neural network, inclusive;

receive from the second client computing device a second compressed audio signal, wherein the second compressed audio signal was compressed using a compression portion of a second artificial neural network separately trained to compress a second user's voice using one or more voice signals of the second user; and decompress the second compressed audio signal using a decompression portion of the second artificial neural network stored on the first client computing device, wherein:

the second artificial neural network comprises an input layer, a middle layer, and an output layer;

the decompression portion of the second artificial neural network comprises all layers of the second artificial neural network between the middle layer of the second artificial neural network and the output layer of the second artificial neural network, inclusive;

each layer of the second artificial neural network comprises one or more nodes;

the middle layer of the second artificial neural network comprises fewer nodes than any other layer of the second artificial neural network; and a decompressed audio signal based on a second audio signal comprises an output of the output layer of the second artificial neural network.

18. The system of claim 17, wherein the processors are further operable when executing the instructions to:

monitor an error rate of the first artificial neural network; and when the error rate exceeds a predetermined threshold, then at least temporarily:

discontinue use of the first artificial neural network to compress the first audio signal; and use a default compression technique to compress the first audio signal.

19. The system of claim 18, wherein the error rate of the first artificial neural network is determined by:

compressing another audio signal using the compression portion of the first artificial neural network;

decompressing the compressed other audio signal using the decompression portion of the first artificial neural network; and comparing the decompressed other audio signal to the other audio signal.

* * * * *